US012134944B2

(12) United States Patent
Trisal et al.

(10) Patent No.: US 12,134,944 B2
(45) Date of Patent: Nov. 5, 2024

(54) HYDRAULIC LANDING NIPPLE

(71) Applicant: Schlumberger Technology Corporation, Sugar Land, TX (US)

(72) Inventors: Krishna Trisal, Yuzhno-Sakhalinsk (RU); Gabriel Isaicu, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 404 days.

(21) Appl. No.: 17/422,559

(22) PCT Filed: Jan. 13, 2020

(86) PCT No.: PCT/US2020/013358
§ 371 (c)(1),
(2) Date: Jul. 13, 2021

(87) PCT Pub. No.: WO2020/150153
PCT Pub. Date: Jul. 23, 2020

(65) Prior Publication Data

US 2022/0098944 A1 Mar. 31, 2022

(51) Int. Cl.

| | |
|---|---|
| ***E21B 23/02*** | (2006.01) |
| ***E21B 34/10*** | (2006.01) |
| ***E21B 37/00*** | (2006.01) |
| *E21B 23/03* | (2006.01) |

(52) U.S. Cl.
CPC ..... *E21B 23/02* (2013.01); *E21B 34/105* (2013.01); *E21B 37/00* (2013.01); *E21B 23/03* (2013.01)

(58) Field of Classification Search
CPC ..... E21B 23/03; E21B 34/105; E21B 37/00; E21B 23/02; E21B 34/10
See application file for complete search history.

(56) References Cited

U.S. PATENT DOCUMENTS

| | | | | |
|---|---|---|---|---|
| 3,494,417 A | | 2/1970 | Fredd | |
| 3,963,074 A | | 6/1976 | Spriggs | |
| 4,044,835 A | * | 8/1977 | Mott | E21B 34/105 166/322 |
| 4,252,197 A | * | 2/1981 | Pringle | E21B 34/105 166/324 |
| 4,418,750 A | | 12/1983 | Paschal, Jr. | |
| 4,454,913 A | * | 6/1984 | Guidry | E21B 34/101 166/324 |
| 4,962,813 A | | 10/1990 | Welch | |
| 4,997,038 A | | 3/1991 | Welch | |

(Continued)

OTHER PUBLICATIONS

International Search Report and Written Opinion issued in PCT Application PCT/US2020/0133358, dated Jun. 5, 2020 (11 pages).

(Continued)

*Primary Examiner* — Brad Harcourt
(74) *Attorney, Agent, or Firm* — Michael Wills, III

(57) ABSTRACT

A hydraulic landing nipple assembly includes a control line port located at an outer surface of a tubular member having a bore therethrough, an upper seal recess positioned above the control line port, and a lower seal recess positioned below the control line port. The upper seal recess and the lower seal recess each define locations within the bore to receive an upper locking mandrel and a lower locking mandrel of a subsurface safety valve.

12 Claims, 2 Drawing Sheets

(56) References Cited

U.S. PATENT DOCUMENTS

| | | | | |
|---|---|---|---|---|
| 4,997,043 | A | 3/1991 | Pringle | |
| 5,954,135 | A | 9/1999 | Williamson et al. | |
| 6,283,218 | B1 | 9/2001 | Collins | |
| 6,854,519 | B2 | 2/2005 | Deaton et al. | |
| 7,775,291 | B2 | 8/2010 | Jacob | |
| 7,896,082 | B2 * | 3/2011 | Lake | E21B 37/06 166/332.8 |
| 8,371,375 | B2 | 2/2013 | Garr et al. | |
| 2009/0229834 | A1 | 9/2009 | Bolding et al. | |
| 2013/0133893 | A1 * | 5/2013 | Anderson | E21B 37/04 166/332.8 |
| 2015/0167423 | A1 | 6/2015 | Kucera | |
| 2015/0240594 | A1 | 8/2015 | Klompsma et al. | |
| 2016/0047198 | A1 | 2/2016 | Hardesty et al. | |

OTHER PUBLICATIONS

International Preliminary Report on Patentability issued in PCT Application PCT/US2020/013358, dated Jul. 29, 2021, 7 pages.

* cited by examiner

HYDRAULIC LANDING NIPPLE

CROSS-REFERENCE TO RELATED APPLICATION

The present document is based on and claims priority to U.S. Provisional Application Ser. No. 62/792,919, filed Jan. 16, 2019, which is incorporated herein by reference in its entirety.

BACKGROUND OF THE DISCLOSURE

This application generally relates to systems and techniques for hydraulic landing nipples, and their use in subterranean formations.

Hydrocarbons, such as oil and natural gas, are generally extracted from subsurface reservoirs by drilling a well that penetrates a targeted hydrocarbon-bearing formation. Once a wellbore has been drilled, the well must be "completed" before hydrocarbons can be produced. A completion process involves the design, selection, and installation of tubulars, tools, and other downhole equipment that are located in the wellbore for the purpose of conveying, pumping, and/or controlling the production of fluids (e.g., hydrocarbons) from the formation.

Each phase of well construction (e.g., drilling, completion, and production) includes using a variety of equipment, including tubular members such as casing, production tubing, landing nipples, and gas lift mandrels; flow control devices such as gas lift valves, subsurface safety valves, and packers; and other downhole equipment, such as perforating guns. In many situations, it is necessary to lower one piece of equipment or a tool into the wellbore so that it can be installed at a particular location (e.g., at a selected depth and/or azimuthal position) in the wellbore. For example, a gas lift valve may be positioned in a selected gas lift mandrel, and there may be several gas lift mandrels disposed at different selected depths in the wellbore. Alternatively, a different well tool may be used to perform a desired action at a desired location in the wellbore (e.g., a perforating gun may be used to perforate well casing at a particular depth proximate a targeted hydrocarbon-bearing formation in the wellbore).

When drilling and completing a well, it is generally necessary to determine when a selected piece of downhole equipment is in a desired location in the wellbore. Prior methods for making this determination include, for example, lowering a tool into the wellbore on a wireline. However, positioning downhole tools in a wellbore "blindly" (e.g., by simply lowering a tool into the wellbore on the wireline or on a drillstring until it "lands" in an associated tool previously positioned in the wellbore) may be an imprecise operation. For example, a wireline retrievable subsurface safety valve can be lowered into a wellbore on a wireline to be installed in a particular hydraulic landing nipple. If, for example, multiple landing nipples are located in the wellbore, the uppermost landing nipple generally must have a large inner diameter, and subsequent landing nipples positioned at increasing depths in the wellbore must have successively smaller inner diameters so that the valve may be placed at the desired depth in the well. This requires the use of multiple sizes (e.g., multiple decreasing inner diameters) of landing nipples, as well as correspondingly sized completion accessories such as locks, wireline retrievable subsurface safety valve, blanking plug etc. In other words, the hydraulic landing nipple may present an inner diameter (ID) restriction in completion such that the reduction in inner diameter limits (1) the size of completion or artificial lift accessories that may installed further downhole in the completion string, and/or (2) the size of intervention tools that can be run through the completion.

Thus, there exists a continuing need for a better hydraulic landing nipple design that does not present a restriction in the completion.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a hydraulic landing nipple assembly that includes a control line port located at an outer surface of a tubular member having a bore therethrough, an upper seal recess positioned above the control line port, and a lower seal recess positioned below the control line port. The upper seal recess and the lower seal recess each define locations within the bore to receive an upper locking mandrel and a lower locking mandrel of a subsurface safety valve.

The present disclosure further introduces a method of removing debris from a subsurface safety valve assembly. The method includes locating the subsurface safety valve assembly that includes a hydraulic landing nipple with a control line port located at an outer surface of a tubular member having a bore therethrough, an upper seal recess positioned above the control line port, and a lower seal recess positioned below the control line port. The upper seal recess and the lower seal recess each define locations within the bore to receive an upper locking mandrel and a lower locking mandrel of a subsurface safety valve. The method further includes pumping a first amount of control fluid through the control line port to remove a first amount of debris, placing a lower seal stack of the subsurface valve assembly in the lower seal recess, pumping a second amount of control fluid through the control line port to remove a second amount of debris present between the lower seal recess and the upper seal recess, and placing an upper seal stack of the subsurface valve assembly in the upper seal recess.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
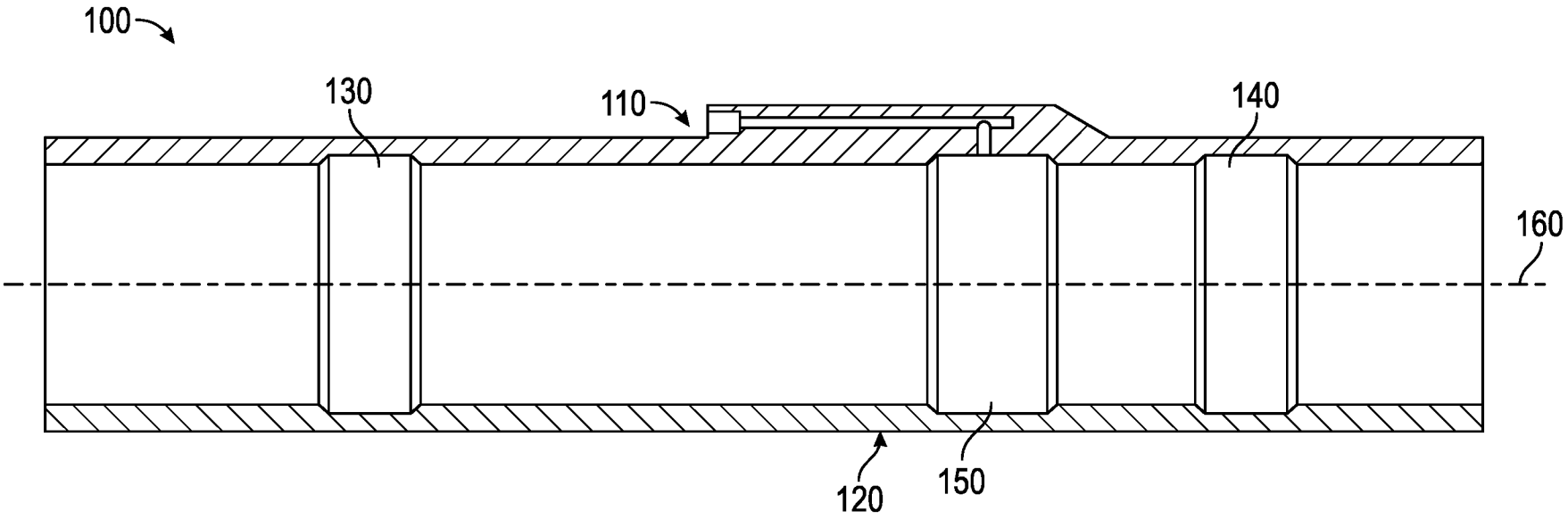
FIG. 1 depicts a schematic diagram of a hydraulic landing nipple assembly at least according to at least a portion of an example implementation according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In the following description, numerous details are set forth to provide an understanding of the present disclosure. However, it may be understood by those skilled in the art that the methods of the present disclosure may be practiced without these details and that numerous variations or modifications from the described embodiments may be possible. At the outset, it should be noted that in the development of any such actual embodiment, numerous implementation—specific decisions may be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In the summary and this detailed description, each numerical value should be read once as modified by the term "about" (unless already expressly so modified), and then read again as not so modified unless otherwise indicated in context. Also, in the summary and this detailed description, it should be understood that a range listed or described as being useful, suitable, or the like, is intended to include support for any conceivable sub-range within the range at least because every point within the range, including the end points, is to be considered as having been stated. For example, "a range of from 1 to 10" is to be read as indicating each possible number along the continuum between about 1 and about 10. Furthermore, one or more of the data points in the present examples may be combined together, or may be combined with one of the data points in the specification to create a range, and thus include each possible value or number within this range. Thus, (1) even if numerous specific data points within the range are explicitly identified, (2) even if reference is made to a few specific data points within the range, or (3) even when no data points within the range are explicitly identified, it is to be understood (i) that the inventors appreciate and understand that any conceivable data point within the range is to be considered to have been specified, and (ii) that the inventors possessed knowledge of the entire range, each conceivable sub-range within the range, and each conceivable point within the range. Furthermore, the subject matter of this application illustratively disclosed herein suitably may be practiced in the absence of any element(s) that are not specifically disclosed herein.

Traditionally, hydraulic landing nipples may be present a number of potential limitations. One such limitation is they present an inner diameter (ID) restriction in completion by limiting the size of the artificial lift or completion components that can be installed further downhole along the completion string. Such an ID restriction also limits the size of intervention tools that can be run through the completion.

The hydraulic landing nipple assembly described in further detail below does not present any ID restriction in the completion, and in doing so, the completion hardware cost and operational complexity can be reduced. Furthermore, the hydraulic landing nipple assembly described herein has the same drift ID as that of the corresponding completion tubing having the same size and weight.

Referring to FIG. 1, an embodiment of a hydraulic landing nipple 100 in accordance with the present disclosure that includes a control line port 110 located on an outer surface of a tubular member 120 having a bore 160 therethrough. As used herein, the phrase "hydraulic landing nipple" or "landing nipple" refers to a completion component fabricated as a short section of heavy wall tubular member having a machined internal surface that provides a seal area and a locking profile. Landing nipples may be included in most completions at predetermined intervals to enable the installation of flow-control devices, such as plugs and chokes. In other words, hydraulic landing nipples are installed as an integrally connected part of the completion string and provide a mechanism of landing, locking and hydraulically controlling surface controlled wireline retrievable safety valves.

The control line port 110 receives a hydraulic line or control line (not shown) from the surface that is used to operate downhole completion equipment such a surface control subsurface safety valve (SCSSV), which will be described in greater detail below. Systems such as these operate on fail-safe basis, where the control line remains pressurized at all times and any leak or failure results in a loss of control line pressure that closes the SCSSV to render the well safe. The tubular member 120 may refer to any type of oilfield pipe, such as drill pipe, drill collars, pup joints, completion tubing, casing and pipeline, isolation valves, subsurface safety valves, sliding doors, or flow control valves.

In embodiments, the hydraulic landing nipple assembly 100 further comprises an upper seal recess 130 positioned above the control line port 110 and a lower seal recess 140 positioned below the control line port 110. In other words, the upper seal recess 130 and the lower seal recess 140 are located on either side of the control line port 110. The upper seal recess 130 and the lower seal recess 140 are located within the bore 160 of the tubular member 120, and are adapted to receive an upper locking mandrel 205 and a lower locking mandrel 210 of a subsurface safety valve 200 (shown in FIG. 2 and discussed in greater detail below).

The hydraulic landing assembly 100 described herein may be used in conjunction with a subsurface safety valve. In an oil and gas subterranean wells, a subsurface safety valve is a downhole valve that remains in an open position to allow fluid to flow through the valve. The safety valve may then be closed to prevent a blowout should an excessive pressure drop or flow occur across the safety valve. One type of subsurface safety valve uses a spring and choke mechanism to close the valve if the well flow rate exceeds a predetermined level. Another type uses a pre-charged chamber to close the valve if the pressure caused by increased flow falls below a predetermined value.

Surface controlled subsurface safety valves are operated from surface facilities through a control line or hydraulic line attached to the external surface of a tubular member. The control system operates in a fail-safe mode, with hydraulic control pressure used to hold open a ball or flapper assembly that will close if the control pressure is lost. These safety valves are typically referred to as surface controlled subsurface safety valves (SCSSV). Presently, there are two basic types of basic types of SCSSV. The first being a wireline retrievable surface controlled subsurface safety valve (WRSCSSV), whereby the principal safety-valve components can be run and retrieved on a wireline or slickline. The second type is referred to as a tubing retrievable surface controlled subsurface safety valve (TRSCSSV), which is outlined below and shown in FIG. 2, in which the entire safety-valve assembly is installed with the tubing string. For illustration purposes only, FIG. 2 of the present application illustrates the hydraulic landing nipple assembly 100 described herein may be deployed with a TRSCSSV 200. One having ordinary skill in the art would be able to envision that the hydraulic landing nipple assembly described herein could be applied to a number of other situations, such as, for example, a WRSCSSV or an isolation valve.

Figure 2:
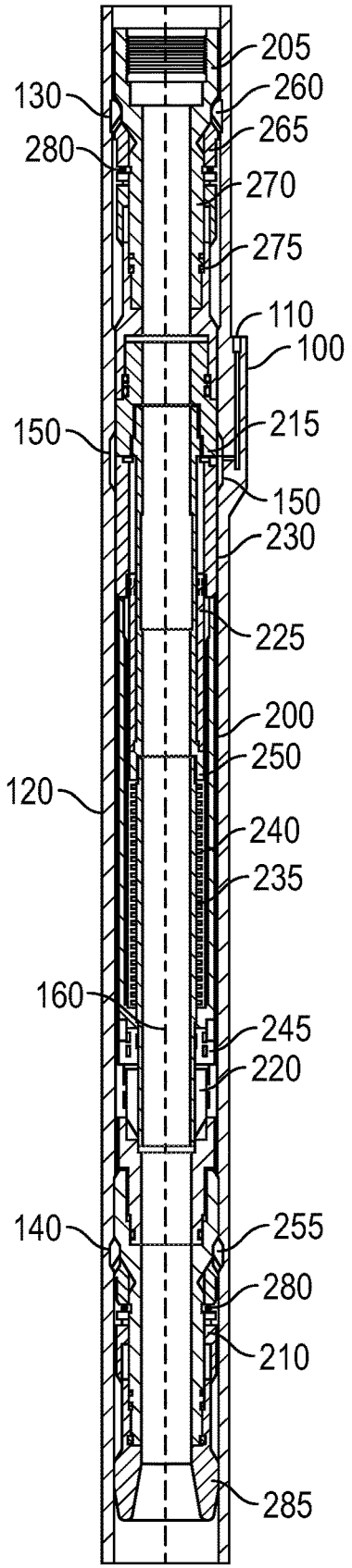
FIG. 2 depicts a hydraulic landing nipple assembly in conjunction with a subsurface safety valve and a plurality of locking devices according to at least a portion of an example implementation according to one or more aspects of the present disclosure.

As shown in FIG. 2, a TRSCSSV 200 is connected to a tubular member 120 downhole. The TRSCSSV 200 has a flap or flapper 220 that is normally biased to block an internal bore 160 of the TRSCSSV 200. To open the flap 220, a single hydraulic control line (not shown) communicates hydraulic pressure from a well control panel (not shown) at the surface to a control line port 110 of the TRSCSSV 200. The hydraulic fluid enters a plurality of housings 230, which provides an impetus to piston 225 to move in the axial direction downhole along with flow tube 235 effectively compressing return spring 240 in the process. The piston 225 may be coupled to the flow tube 235 via the yoke 250 such that the piston 225 and the flow tube 235 move in tandem. When the flow tube 235 is moved, it causes the hinge 245 of the flap 220 to open so that fluid can pass through the bore 160 of the TRSCSSV 200. The TRSCSSV 200 may be closed in response to uncontrolled fluid flow and/or pressure drop at the surface well control panel by eliminating the hydraulic pressure applied at control line port 110 such that the return spring 240 decompresses and moves the flow tube 235 in an axial direction uphole such that the flap 220 closes the bore 160.

In one or more embodiments, the hydraulic landing nipple assembly 100 does not include any polished bores. Conventional hydraulic landing assemblies include a locking recess and a control line port located between two polished bores. The control line port terminates in a connection on the outer diameter (OD) of the hydraulic landing nipple. A wireline retrievable surface controlled subsurface safety valve (WRSCSSV) may then be made up to a lock assembly on surface and deployed in the well so that it can be set inside the hydraulic landing nipple. However, the polished bores for these conventional designs could be damaged during through-tubing interventions with wireline or slickline. A damaged polished bore does not allow the seals of the lock assembly to engage against the inner diameter of the tubular, rendering the wireline safety valve inoperable.

In one or more embodiments, the hydraulic landing nipple assembly further comprises a third recess or a hydraulic port recess 150 located at a point between the upper seal recess 130 and the lower seal recess 140 and adjacent to the control line port 110. If the hydraulic landing nipple assembly is deployed in a tubing retrievable surface controlled subsurface safety valve 200 (TRSCSSV) (described in greater detail in FIG. 2 and below), the hydraulic port recess 150 may be adapted to receive an upper sub portion 215 of the TRSCSSV 200.

As discussed above, the upper seal recess 130 and lower seal recess 140 are located within the bore 160 of the tubular member 120. The locking mandrels (also referred to as locks or locking devices) are downhole devices, run and retrieved on wireline or slickline, that are placed and anchored within a tubular member or string to provide a setting point for flow-control equipment such as valves, chokes and plugs. The upper locking mandrel 205 further includes an upper seal 260 that communicates with the upper recess 130 to provide a sealing mechanism in this portion of the wellbore. The lower locking mandrel 210 further includes a lower seal 255 that communicates with the lower seal recess 140 to provide a sealing mechanism in this portion of the wellbore. Such seals 255 and 260 effectively provide a sealing mechanism against the ID of the tubular member 120 and block the flow of hydrocarbon fluids from the formation, along with a setting point for the TRSCSSV 200.

The locking mandrels 205 and 210 provide a mechanical anchoring point and sealing for the run-in-hole assembly (upper locking mandrel 205, TRSCSSV 200 and lower locking mandrel 210). When setting the lock for the upper locking mandrel 205, the expander mandrel 265 shifts down, which expands the upper seal 260. The upper seal 260 may be a single piece or include multiple radial segments each located into the upper seal recess 130. The seals 255 and 260 separately provide the mechanical support such that the run-in-hole assembly cannot move up or down the hydraulic landing nipple once it is set in place. The shear pins 280 lock the motion of the expander mandrel 265 once the upper seal 260 is located in the respective seal recess. Retrieving the run-in-hole assembly entails causing the shear pins 280 to fail applying a shearing mechanism or force, which allows the expanding mandrel 265 to move upwards leaving the upper seal 260 unsupported and possibly collapsing out of the upper seal recess 130. The sealing mechanism for the lower seal 255 may be similar to the sealing mechanism for the upper seal 260 described above. The crossover 275 is a tubular with threads on each end used to make up the upper locking mandrel 205 and/or the lower locking mandrel 210 to the TRSCSSV 200. The crossover 275 may also isolate pressure/fluid flow. The nose 285 is a tapered tubular part that attaches to the lower locking mandrel 210 and serves the purpose of facilitating the run-in-hole operation when the assembly is traveling through equipment already installed in the well. Nose 285 also facilitates the passage of intervention equipment through the upper locking mandrel 205 and TRSCSSV 200. The facilitation is achieved by having angled and round edges, which prevent the lower locking mandrel 210 from getting hung up on the edges or features of existing well equipment when being lowered in the well or when other tools are being passed through the lower locking mandrel 210.

The staged setting of the upper locking mandrel and lower locking mandrel also allows one to potentially remove debris from the hydraulic system of the subsurface safety valve assembly more efficiently. First, the subsurface safety valve assembly described above may be located, and a first amount of control fluid may then be pumped through the control line port to remove a first amount of debris. The lower seal may then be placed in the lower recess, and a second amount of control fluid is pumped through the control line port to remove a second amount of debris present between the lower seal recess and the upper seal recess. The upper seal may then be placed in the upper seal recess. The operation of the safety valve or other hydraulically operated equipment often necessitates a clean fluid. The debris removal step helps to ensure the reliability of the safety valve or other hydraulically operated equipment that is located in the hydraulic landing nipple.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' or 'step for' together with an associated function without the recitation of structure.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. A hydraulic landing nipple assembly comprised of:

a control line port located at an outer surface of a tubular member having a bore therethrough;

an upper seal recess positioned above the control line port on the tubular member;

a lower seal recess positioned below the control line port on the tubular member;

wherein the upper seal recess and the lower seal recess each define locations within the bore to receive an upper locking mandrel and a lower locking mandrel of a subsurface safety valve;

wherein the upper seal recess receives an upper seal of the upper locking mandrel when an upper expander mandrel shifts downward and expands the upper seal;

a first shear pin locks the downward shift of the upper expander mandrel;

wherein the lower seal recess receives a lower seal of the lower locking mandrel when a lower expander mandrel shifts downward and expands the lower seal;

a second shear pin locks the downward shift of the lower expander mandrel;

and wherein the upper lock mandrel and lower lock mandrel separately provide mechanical anchoring and sealing support for the subsurface safety valve.

2. The hydraulic landing nipple assembly of claim 1, wherein the assembly further comprises a hydraulic port recess positioned at a point between the upper seal recess and the lower seal recess and adjacent to the control line port.

3. The hydraulic landing nipple assembly of claim 2, wherein the subsurface safety valve is a wireline retrievable surface controlled subsurface safety valve.

4. The hydraulic landing nipple assembly of claim 2, wherein the subsurface safety valve is a tubing retrievable surface controlled subsurface safety valve.

5. The hydraulic landing nipple assembly of claim 2, wherein the hydraulic port recess is adapted to receive a sub portion of the subsurface safety valve.

6. The hydraulic landing nipple assembly of claim 1, wherein the assembly does not comprise any polished bores.

7. A method of removing debris from a subsurface safety valve assembly, the method comprising:

locating the subsurface safety valve assembly comprised of a hydraulic landing nipple, the hydraulic landing nipple comprised of:

a control line port located at an outer surface of a tubular member having a bore therethrough;

an upper seal recess positioned above the control line port on the tubular member;

a lower seal recess positioned below the control line port on the tubular member;

wherein the upper seal recess and the lower seal recess each define locations within the bore to receive an upper locking mandrel and a lower locking mandrel of a subsurface safety valve;

pumping a first amount of control fluid through the control line port to remove a first amount of debris;

placing a lower seal stack of the subsurface valve assembly in the lower seal recess and expanding the lower seal by shifting a lower expander mandrel downward until a shear pin locks the movement of the lower expander mandrel;

pumping a second amount of control fluid through the control line port to remove a second amount of debris present between the lower seal recess and the upper seal recess; and placing an upper seal of the subsurface valve assembly in the upper seal recess and expanding the upper seal by shifting an upper expander mandrel downward until a shear pin locks the movement of the upper expander mandrel; and the upper lock mandrel and the lower lock mandrel separately provide mechanical anchoring and sealing support for the subsurface safety valve.

8. The method of claim 7, wherein the assembly further comprises a hydraulic port recess positioned at a point between the upper seal recess and the lower seal recess and adjacent to the control line port.

9. The method of claim 8, wherein the hydraulic port recess is adapted to receive a sub portion of the tubing retrievable surface controlled subsurface safety valve.

10. The method of claim 7, wherein the subsurface safety valve is a wireline retrievable surface controlled subsurface safety valve.

11. The method of claim 7, wherein subsurface safety valve is a tubing retrievable surface controlled subsurface safety valve.

12. The method of claim 7, wherein the assembly does not comprise any polished bores.

* * * * *